US009420366B2

(12) United States Patent
Whitney

(10) Patent No.: US 9,420,366 B2
(45) Date of Patent: Aug. 16, 2016

(54) EARBUD ACCESSORY

(71) Applicant: Heidi Lynne Whitney, Santa Barbara, CA (US)

(72) Inventor: Heidi Lynne Whitney, Santa Barbara, CA (US)

( * ) Notice: Subject to any disclaimer, the term of this patent is extended or adjusted under 35 U.S.C. 154(b) by 0 days.

(21) Appl. No.: 14/596,618

(22) Filed: Jan. 14, 2015

(65) Prior Publication Data

US 2016/0205457 A1 Jul. 14, 2016

(51) Int. Cl.
*H04R 1/10* (2006.01)

(52) U.S. Cl.
CPC ..... *H04R 1/1016* (2013.01)

(58) Field of Classification Search
CPC .... H04R 1/10; H04R 2205/022; H04R 1/105; H04R 5/0335; H04R 2201/10
USPC ..... 381/370, 374, 384
See application file for complete search history.

(56) References Cited

U.S. PATENT DOCUMENTS

| | | | | |
|---|---|---|---|---|
| 6,233,345 | B1 | 5/2001 | Urwyler | |
| 7,348,490 | B2 | 3/2008 | Sakai | |
| 7,650,007 | B2 | 1/2010 | Iuliis et al. | |
| 7,936,895 | B2 | 5/2011 | Wang et al. | |
| 8,116,503 | B2 * | 2/2012 | Daniels | H01H 17/02 381/384 |
| 2010/0104126 | A1 | 4/2010 | Greene | |
| 2011/0243346 | A1 | 10/2011 | Aase et al. | |
| 2012/0230533 | A1 | 9/2012 | Dallas | |
| 2012/0314895 | A1 | 12/2012 | Siebenberg | |
| 2013/0022226 | A1 | 1/2013 | Anderson | |
| 2014/0169610 | A1 | 6/2014 | Pang et al. | |

OTHER PUBLICATIONS

Geekologie, http://geekologie.com/2011/02/yes-im-a-doctor-stethoscope-he.php.
Schwarztech, http://schwarztech.net/reviews/jblreference220.
EBay, http://www.ebay.com/itm/SONY-EARPHONES-HEADPHONES-MDR-U5-STETHOSCOPE-DOCTOR-EARPHONES-TYPE-JAPAN-/251299589021.
Allmri, http://www.allmri.com/product_info.php?language=en&info=p276_stethoscope-style-pneumatic-headphone.html&.

* cited by examiner

*Primary Examiner* — Suhan Ni
(74) *Attorney, Agent, or Firm* — Chris Lambrecht

(57) ABSTRACT

Disclosed is an earphones accessory apparatus that can be removably attached to a set of earphones. The earphone accessory may provide a structure that prevents the earphone wires from becoming tangled and facilitates easy insertion and removal of the earphones. The earphone accessory may include a plurality of channel-bearing legs for guiding the earphone wires into a trunk. The channel of at least one of the legs may be discontinuous so as to accommodate, for example, an in-line volume control disposed in one of the earphone wires.

11 Claims, 2 Drawing Sheets

FIG. 2
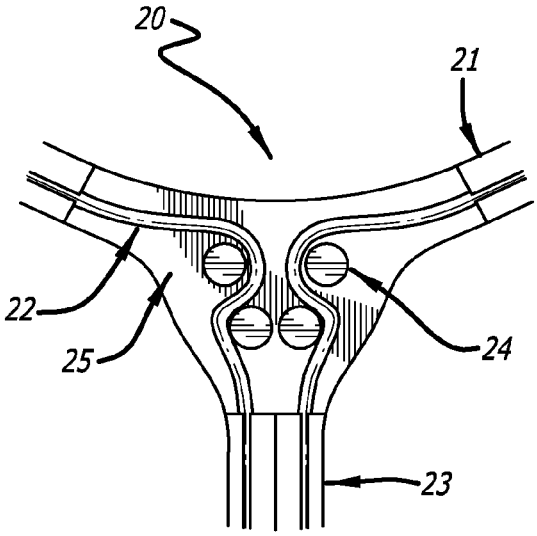
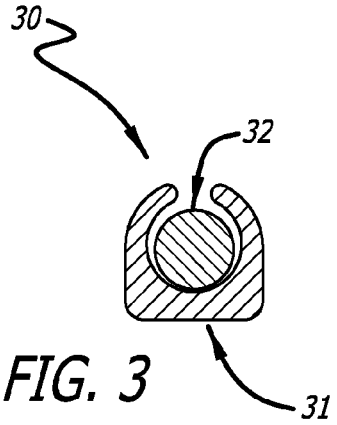
FIG. 3
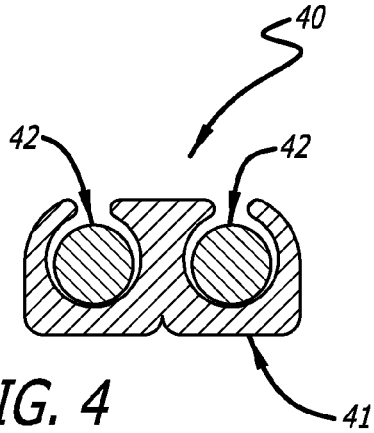
FIG. 4
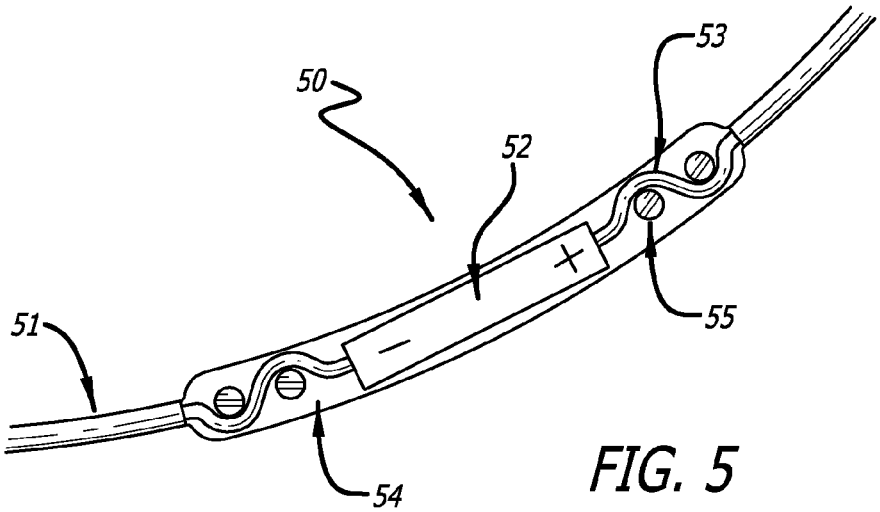
FIG. 5

EARBUD ACCESSORY

BACKGROUND

Earphones or headphones are well known in the art. One variety of stereo earphones, often referred to as "earbuds," typically include a stereo audio plug coupled to a pair of speaker enclosures, or earbuds, via a pair of soft, insulated wires. Typically, the earbuds are appropriately sized and shaped to fit in the opening of the ear canal. In use, the audio plug is coupled to an audio signal source, such as a laptop, music player, or mobile phone. The left and right earbuds are inserted into the user's left and right ears, respectively, where they are held in place by friction. The wires feeding from the earbuds typically dangle downwards from the ears under their own weight. Because they lack a headband or other rigid structure connecting the speaker housings, earbuds are less prone to structural damage and can be stored more compactly than other types of earphones or headphones. However, earbuds do suffer a number of drawbacks due to the fact that there is no rigid coupling between the earbuds.

SUMMARY

An object of the disclosure is to provide an accessory that can be readily attached to or removed from a set of earbuds that overcomes the drawbacks associated with earbud-style headphones. In one aspect, the disclosure provides an earbud accessory that includes a pair of elongated legs joined by a trunk at one end and spaced to span the width of a human head at the opposite, or terminal, end of the leg. Each of the left and right earbuds can be inserted into the terminal end of one of the legs, and their wires fed through a channel that runs along each leg and on through the trunk. By providing a more rigid structure between the earbuds, not only are the earbud wires less prone to tangle, but the earbuds themselves can be more easily placed in or removed from the user's ears, e.g., using a single motion of one hand. In addition, the earbuds can be conveniently hung around the user's neck when not in use, much like a stethoscope. Because the accessory is detachably coupled to the earbuds, the accessory can later be detached from the earbuds, thereby allowing the earbuds to be stored in a relatively small space. Moreover, the accessory can be replaced without requiring the user to also replace the earbuds themselves.

BRIEF DESCRIPTION OF THE DRAWINGS

FIG. 2 is a view of an exemplary trunk section of an earbud accessory in accordance with the disclosure.

FIG. 3 is a cross-sectional view of an exemplary leg of an earbud accessory in accordance with the disclosure.

FIG. 4. is a cross-sectional view of an exemplary trunk section of an earbud accessory in accordance with the disclosure.

FIG. 5 is a view of an exemplary controller section of a leg of an earbud accessory in accordance with the disclosure.

DETAILED DESCRIPTION

Figure 1:
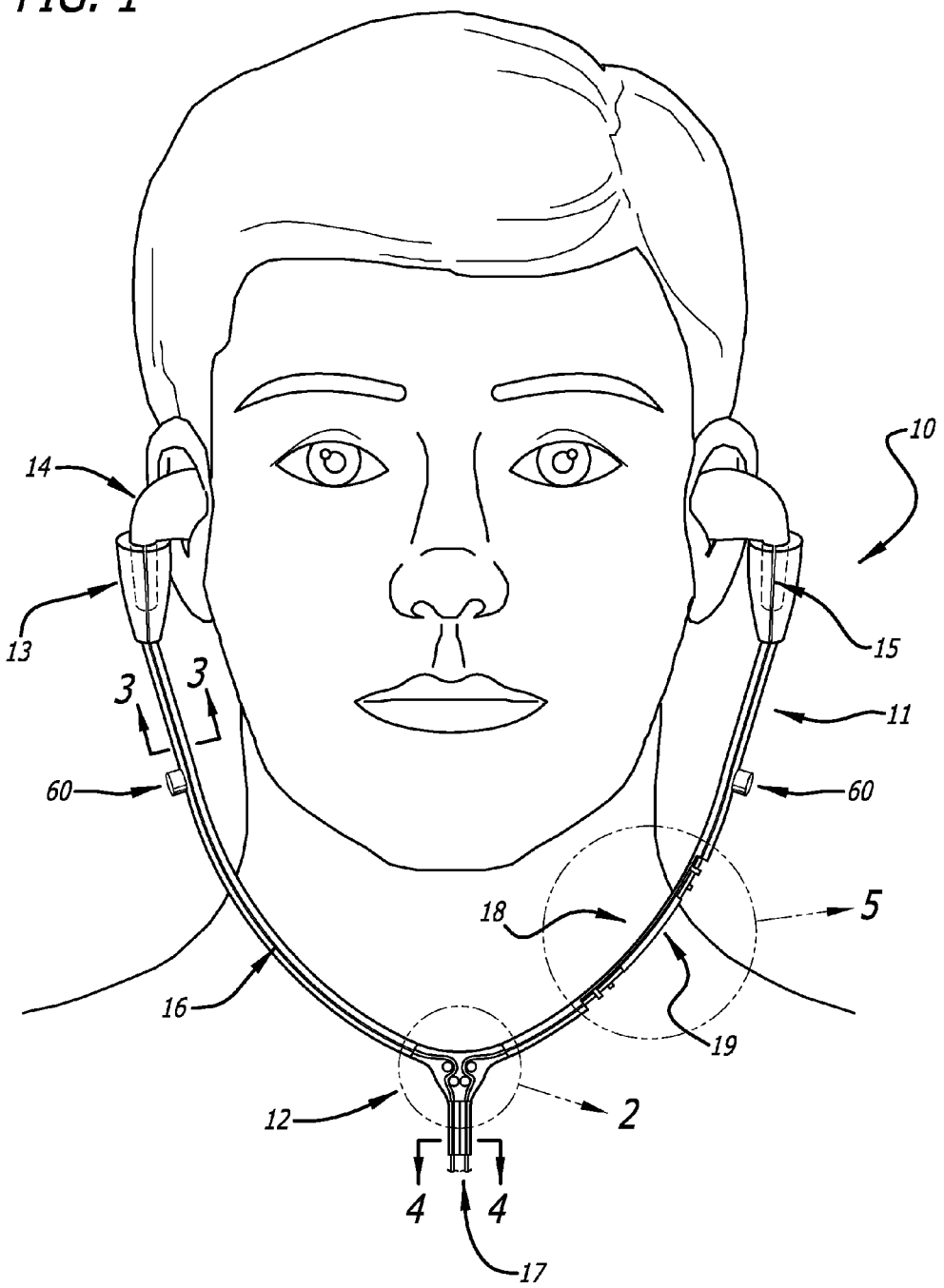
FIG. 1 is a view of an exemplary earbud accessory in accordance with the disclosure.

Referring to the drawings more particularly by reference numbers, FIG. 1 shows an exemplary headphones accessory 10, which may be used in conjunction with a set of "earbuds" or other similar headphone devices. The headphones accessory 10 may include a pair of legs 11 joined at one end by a trunk section 12. Opposite the trunk section 12, each leg may include a terminal section 13. The accessory 10 may be formed of any suitable material with sufficient rigidity to retain its overall shape while still allowing some deformation. For example, the accessory 10 may be formed of a thermoplastic with elastomeric features using an injection molding process.

Each individual speaker housing or "earbud" 14 may include a stem (shown in dotted lines) that can be inserted into the terminal section 13 of each leg 11. Once inserted, the terminal section 13 may operate to hold the earbud 14 in place by friction. It is to be appreciated that the terminal sections 13 may take a variety of forms to accommodate earbuds of different designs. The terminal section 13 of each leg 11 may have a slit or seam 15 that allows a wire exiting the speaker housing to be pulled or fed through the terminal section 13.

Each leg 11 may also include a channel 16 that runs along the long axis of the leg 11. The channel may be configured to receive and guide each earbud wire 17 from the terminal section 13, along the leg 11, through the trunk section 12, and out the bottom of the accessory 10. The channel may run the length of the leg 11 continuously, or may stop or resume at any place along the length of the leg 11. For example, FIG. 1 illustrates a leg 11 on the left side of the figure as having a channel 16 that runs continuously between the terminal section 13 and the trunk section 12. Some earbuds may include a microphone, volume control, or other piece of hardware disposed in-line with one or more of the earbud wires. Because these elements may not fit within the channel, one or more of the legs 11 may have a discontinuous channel or other means of accommodating the in-line hardware. For example, the leg 11 on the right side of FIG. 1 is illustrated as having a controller section 18. In this embodiment, the channel runs continuously from the terminal section 13 down to approximately the midpoint of the leg 11, where the channel ends and the controller section 18 begins. At the other end of the controller section 18, the channel resumes before feeding into the trunk section 12. In this instance, the controller section 18 accommodates an in-line volume control apparatus 19 found in some models of earbuds, while the remainder of the earbud wire 17 is held securely by the channel-bearing portions of the leg 11 on either side of the controller section 18. By way of example only, the controller section may span anywhere from 0.25 inches to 3 inches of the leg, so as to accommodate in-line hardware of various sizes and shapes. In an another embodiment, the leg 11 could have a continuous channel with a section of the channel having a larger cross-sectional diameter than the rest of the channel, so as to accommodate the volume control 19 or other in-line hardware. Although the accessory 10 is illustrated with the controller section 18 on the right leg, it is to be appreciated that the controller section 18 could be on the other leg, or both legs. Similarly, while channel 16 is illustrated as opening out of the page, it is to be appreciated that channel 16 could open on any side of the leg.

The accessory 10 may further include one or more nubs 60 protruding outward from each leg to facilitate wrapping of excess wires around the accessory when not in use.

FIG. 2 illustrates an exemplary trunk section 20 of an earphones accessory in accordance with the disclosure. At the trunk section 20, the ends of each leg 21 may be joined, and their respective wires 22 may be fed into a single trunk 23. The trunk section 20 may include one or more anchors 24 for guiding the wires 22 through the trunk section 20 or otherwise securing the wires 22 to the trunk section 20. For example, as shown in FIG. 2, the trunk section may include an open portion 25 where the wires 22 exit their respective leg channels and are threaded through one or more anchors 24 before being fed into the trunk. As illustrated in FIG. 2, the one or more anchors 24 may take the form of one or more "s-joints" formed by a plurality of closely-spaced cylindrical nubs that pinch the wire or otherwise hold the wire in place by friction. It is to be understood that the illustrated trunk section is exemplary only, and other embodiments are also contemplated. For example, in place of the open section 25, the leg channels could instead simply run continuously into the trunk 23.

FIG. 3 illustrates an exemplary cross-section 30 of a section of leg 31 having a channel for guiding an earbud wire 32 along the length of the leg 31. As shown in FIG. 3, the cross section 30 is an open or "c-channel" cross section, allowing the wire to pressed into the channel along the length of the leg 31. FIG. 4 illustrates an exemplary cross-section 40 of the trunk 41, which may include parallel channels for guiding both earbud wires 42 through the bottom of the headphone accessory. As with leg 31 in FIG. 3, each channel in trunk 41 may have an open cross section. The legs 31 and trunk 41 are adapted so that the wires 32 and 42 can be pressed into or pulled out of their respective channels by a person using their fingers. It is to be appreciated that although FIG. 4 shows separate channels for each wire 42, the trunk 41 could be adapted to accommodate both wires in a single channel.

FIG. 5 illustrates an exemplary controller section 50 of a leg 51 of a headphones accessory in accordance with the disclosure. As illustrated, the channels of the leg 51 approaching from the left and the right side of the controller section 50 may terminate for a section of the leg so that the leg may accommodate a volume controller 52 in-line with a wire 53 of the earbuds. The controller section 50 of the leg 51 may have a cross-section with a flat portion or otherwise include a generally flat surface 54 upon which the volume control 52 may rest. The controller section 50 may be wider than the rest of the leg to accommodate for variously-sized volume controllers, microphones, or other in-line devices. In order to keep the volume control 52 in place, the controller section 50 may also include one or more anchors 55 for securing the wires 53 at either end of the volume control 52. As illustrated in FIG. 5, each of the one or more anchors 55 may take the form of one or more raised, cylindrical nubs adapted to pinch or otherwise hold a wire 53 in place by friction. Alternatively or additionally, the controller section 50 could be adapted to anchor the volume control 52 itself.

In use, the earbuds may be inserted into the terminal portion of each leg, and their respective wires fed through the channel sections of each leg and on through the trunk section. Generally, the legs are adapted to allow the earbud wires to be pressed into the channels where the wires are held in place until pulled out of the channels under sufficient force. Once installed in the accessory, the earbuds can be easily inserted into or removed from the user's ears using one hand. Additionally, the structure of the accessory allows the earbuds to be hung from the user's neck like a stethoscope when not in immediate use. The accessory also prevents the earbud wires from becoming tangled when, for example, placed in a drawer, purse, or backpack. Moreover, because the earbuds and the accessory can be quickly separated, the earbuds can still be stored in a relatively compact space.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

I claim:

1. A wired earphones accessory apparatus for use in conjunction with a set of earphones having first and second speaker housings coupled to first and second insulated wires, respectively, and a controller housing coupled to said second wire, the accessory comprising:

a first leg, said first leg having a first end adapted to receive the first speaker housing of said earphones, and a cross section having a channel adapted for receiving the first wire coupled to said first speaker housing;

a second leg, said second leg having a first end adapted to receive the second speaker housing of said earphones, a first section and a second section each having a channel adapted for receiving the second wire coupled to said second speaker housing, and a third section, disposed between said first and second sections along the length of said second leg, said third section having a cross section adapted to accommodate the controller housing coupled to said second wire, wherein said cross-section of said third section is different from said cross sections of said first and second sections; and, a trunk section joining a second end of said first leg and a second end of said second leg, wherein the accessory and the set of earphones are distinct structures that can be conjoined and disjoined without affecting the operability of the earphones.

2. The apparatus of claim 1, further comprising an anchor on a surface of said third section of said second leg for immobilizing said controller housing.

3. The apparatus of claim 2, wherein said anchor comprises at least one pair of nubs arranged to pinch said second wire at one end of said controller housing.

4. The apparatus of claim 3, wherein said anchor comprises a second set of nubs arranged to pinch said second wire at another end of said controller housing.

5. The apparatus of claim 1, wherein said first ends of said legs each includes a terminal section having a diameter larger than that of said first leg.

6. The apparatus of claim 5, wherein said terminal sections each includes a channel that is wider than that of said first leg.

7. The apparatus of claim 1, wherein said trunk section includes a first wire channel and a second wire channel adapted for receiving said first and second wires, respectively.

8. The apparatus of claim 7, wherein said trunk section includes one or more anchors for immobilizing said first and second wires.

9. The apparatus of claim 1, wherein said first and second legs each includes a nub projecting perpendicular to the length of each leg at approximately the midpoint of the length of each leg.

10. The apparatus of claim 1, wherein said apparatus is formed of a thermoplastic.

11. The apparatus of claim 1, wherein said cross section of said first leg is an open cross section.

* * * * *